US007410094B2

(12) United States Patent
Bos

(10) Patent No.: US 7,410,094 B2
(45) Date of Patent: Aug. 12, 2008

(54) MULTI-LEVEL PARTITION ASSEMBLY

(75) Inventor: Mark Bos, West Olive, MI (US)

(73) Assignee: Bradford Company, Holland, MI (US)

( * ) Notice: Subject to any disclaimer, the term of this patent is extended or adjusted under 35 U.S.C. 154(b) by 596 days.

(21) Appl. No.: 11/010,619

(22) Filed: Dec. 13, 2004

(65) Prior Publication Data

US 2006/0124713 A1 Jun. 15, 2006

(51) Int. Cl.
*B65D 25/04* (2006.01)

(52) U.S. Cl. ..... 229/120.36; 229/120.02; 229/120.38; 220/529

(58) Field of Classification Search ..... 229/120.02, 229/120.29, 120.36, 120.38, 167, 120.13; 220/528, 529, 552; 217/26, 29, 30, 31, 32
See application file for complete search history.

(56) References Cited

U.S. PATENT DOCUMENTS 2,888,186 A * 5/1959 Meyers ..... 229/120.24
2,989,222 A * 6/1961 Haffenreffer ..... 229/120.13
3,343,742 A * 9/1967 Siegler ..... 229/120.36
3,999,662 A * 12/1976 Barnhardt ..... 211/126.16
4,065,021 A * 12/1977 Kedzierski ..... 220/22
4,148,428 A * 4/1979 Gardner ..... 229/15
4,180,164 A 12/1979 Durden et al.
4,753,341 A * 6/1988 McIntyre ..... 211/130.1
5,131,543 A 7/1992 Stephens
5,249,685 A 10/1993 Stephens
5,597,113 A 1/1997 Bradford
5,732,876 A 3/1998 Bradford
6,045,038 A * 4/2000 Smith et al. ..... 229/167

* cited by examiner

*Primary Examiner*—Nathan J Newhouse
*Assistant Examiner*—Christopher Demeree
(74) *Attorney, Agent, or Firm*—Wood, Herron & Evans, LLP

(57) ABSTRACT

A partition assembly for dividing the space inside a container into two levels is provided. The partition assembly comprises first and second sets of parallel dividers or partitions. The dividers of the first set each have at least one tongue. One divider from the second set of parallel dividers has a series of spaced passages which are aligned with and adapted to receive the respective tongues of the dividers of the first set of dividers. When the one divider is folded or bent, multiple levels are created in the partition assembly.

5 Claims, 5 Drawing Sheets

MULTI-LEVEL PARTITION ASSEMBLY

FIELD OF THE INVENTION

The present invention relates generally to shipping containers used to ship products, and more specifically to a partition assembly for dividing the space inside a container.

BACKGROUND OF THE INVENTION

In the storage, shipment, or display of parts or merchandise, it is a common practice to divide the interior of a box or container into a plurality of individual cells. The interior of a box or container is typically separated by a series of dividers, one set of parallel dividers being orthogonal to a second set of parallel dividers. The dividers separate the interior of the box or container into a plurality of individual cells or compartments each of which is intended to hold a separate item during shipment or for display. The partitioning of the interior of the box or container helps prevent the items from contacting one another, from breaking during shipment, and assists in the loading, unloading and inventorying the contents of each container.

However, when certain products are loaded into the cells of a box or container, there may be extra or empty space within one or more of the cells of the container. This empty or wasted space is inefficient and increases shipping and storage costs per product item or product weight, as compared to product that more fully fills the cells of a partitioned container or box. This problem is particularly pronounced when irregularly-shaped products, such as are commonly used in the automotive industry, are shipped.

The dividers used to partition the interior space of a container are traditionally slotted and arranged in an orthogonal relationship to divide the interior of the box or container into a desired number of cells. The dividers are typically slotted in a manner that enables the dividers to engage with one another at the location of the slots so that the dividers form an orthogonal grid or matrix. Typically, the dividers are made of the same material as the material of the box or container, for example, paperboard, chipboard, or plastic. Assembly of these traditional partition assemblies or systems typically requires that the individual dividers be arranged and engaged together. In other words, a new matrix must be built or assembled for each container. The assembly and/or disassembly process can take time and thus increases labor costs. In addition, there is always a quality control concern that the partitions will be assembled properly.

Accordingly, it is an objective of the present invention to provide a partition assembly which may increase the number of parts, particularly irregularly-shaped parts, that can be shipped or stored in a container.

It is also an objective of the present invention to allow for a collapsible partition assembly that may provide multiple levels of cells for shipping or storing parts.

These objectives and other objectives will become more readily apparent from the further description of the invention below.

SUMMARY OF THE INVENTION

The above objectives and other objectives are addressed by the present invention, which provides a partition assembly for dividing the space inside a container. The partition assembly comprises a first set of parallel dividers or partitions, with each divider having at least one tongue. The partition assembly also has a second set of parallel dividers which are engaged with the first set of parallel dividers so that each divider of the first set of parallel dividers intersects each divider of the second set of parallel dividers at an intersection. Finally, a section divider, one of the dividers from the second set of parallel dividers, has a series of spaced passages which are aligned with and adapted to receive the respective tongues of the dividers of the first set of dividers.

In a preferred embodiment, each divider of the first set of parallel dividers has a series of spaced slots extending inwardly from an edge of the divider. Each divider of the second set of parallel dividers also has a series of spaced slots extending inwardly from an edge of the divider. The inwardly extending slots of the first set of parallel dividers engage with the inwardly extending slots of the second set of parallel dividers at intersections to create a partition matrix or assembly. Moreover, in a preferred embodiment, the entire partition assembly is collapsible. In another preferred embodiment, the dividers of the first set of parallel dividers and the dividers of the second set of parallel dividers may be fixedly attached to one another, in which case the dividers are not separable from each other.

One of the dividers of the second set of dividers, referred to as a section divider, has a fold line and is adapted to be orthogonally folded along the fold line to create a horizontal portion and a vertical portion, the horizontal portion dividing the partition assembly into two layers or levels. In an alternative embodiment, the section divider is rigid and the fold line forms a right angle which divides the section divider into two portions, orientated perpendicular to one another. Typically, a smaller first vertical portion contains slots that engage the slots of the first set of parallel dividers, and a second horizontal portion has passages that engage with the tongues of the first set of parallel dividers.

The use of the section divider or partition allows irregularly-shaped products, such as L-shaped products, to be stacked essentially on top of one another. This provides for doubling the product density in a particular box or container, and still allows for easy access, display and inventory of the products in a particular box. In addition, the joinder of the parallel dividers keeps the partition assembly intact, and does not require that the partition assembly be reconnected or reassembled each time a package is reused. Additionally, because in some embodiments the partition assembly is collapsible, it allows for easy transport and storage of the partition assemblies while still ensuring that the dividers remain interconnected.

In addition, the present invention comprises a method for forming a partition assembly for dividing space inside a container. The method comprising the steps of engaging the inwardly extending slots of the dividers of the first set of dividers with the inwardly extending slots of the dividers of the second set of dividers and engaging the tongues of the dividers of the first set of dividers with the spaced passages of the section divider. The method can further comprise a step of folding the section divider along a fold line prior to passing the tongues of the dividers of the first set of dividers through the spaced passages of the section divider.

The present invention also comprises a method of forming a container and a partition assembly which includes the step of placing and/or securing the partition assembly in a container.

BRIEF DESCRIPTION OF THE DRAWINGS

The accompanying drawings, which are incorporated in and constitute a part of this specification, illustrate preferred embodiments of the invention and, together with a general description of the invention given below, serve to explain the principles of the invention.

DETAILED DESCRIPTION

Figure 1:
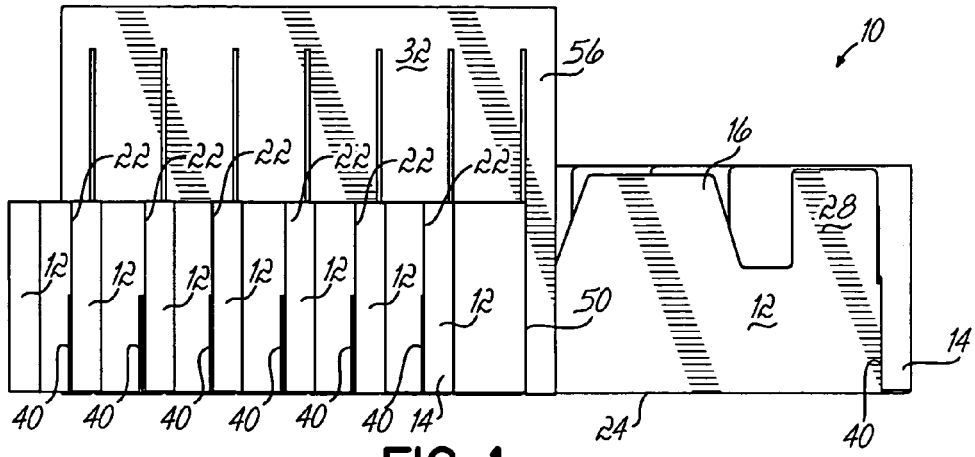
FIG. 1 is a front elevational view of one preferred embodiment of the partition assembly of the present invention, showing the partition assembly in a collapsed position.
Figure 1A:
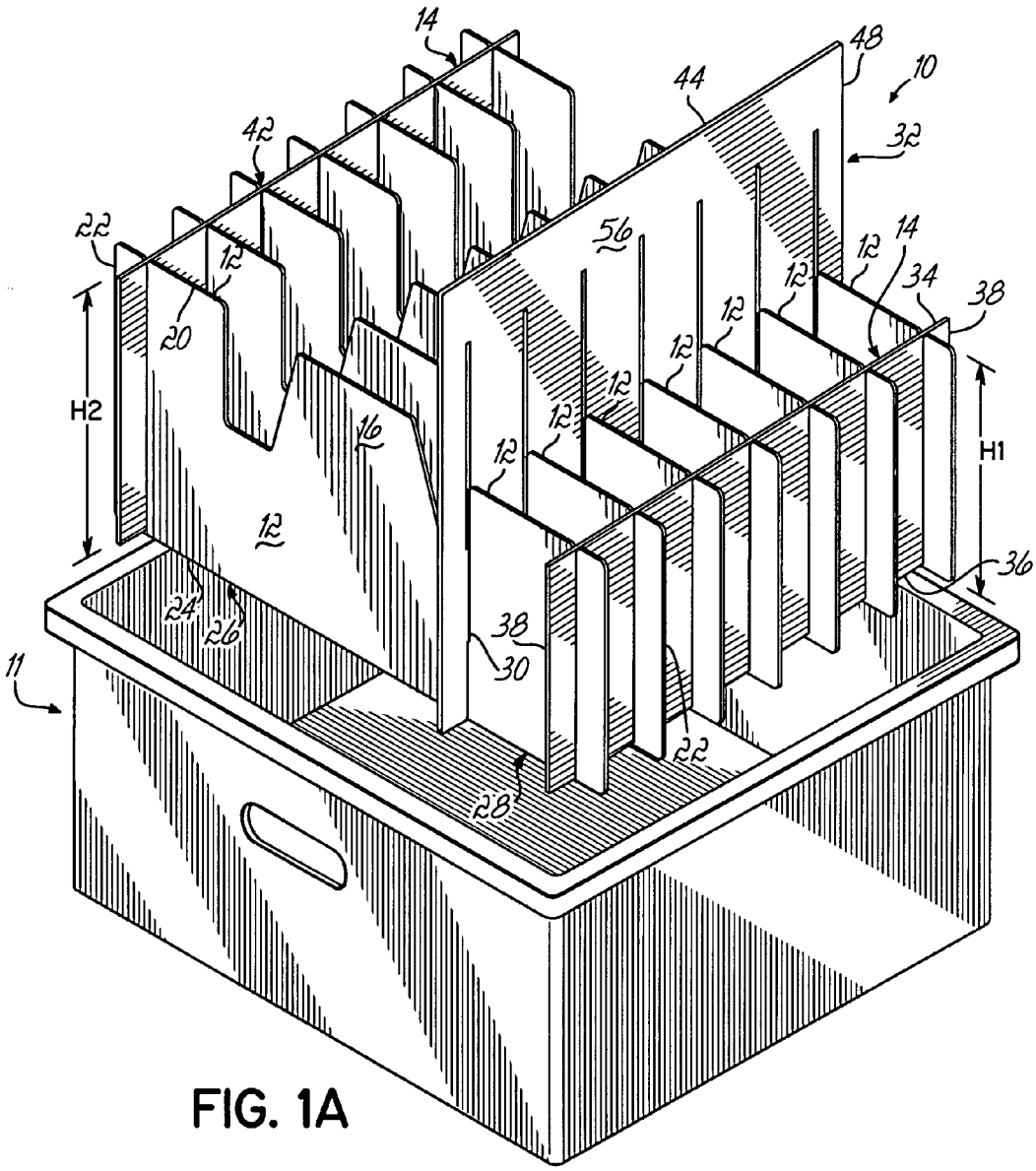
FIG. 1A is a perspective view of the partition assembly of FIG. 1, showing the partition assembly erected, along with the container in which the erected partition assembly is to be inserted.

FIG. 1 shows a collapsible partition assembly 10 in a collapsed or folded position. FIG. 1A illustrated the partition assembly 10 erected and being inserted into a box or container 11. Although one configuration of container 11 is illustrated, the partition assembly 10 of the present invention may be used in any type of container or box.

Figure 2:
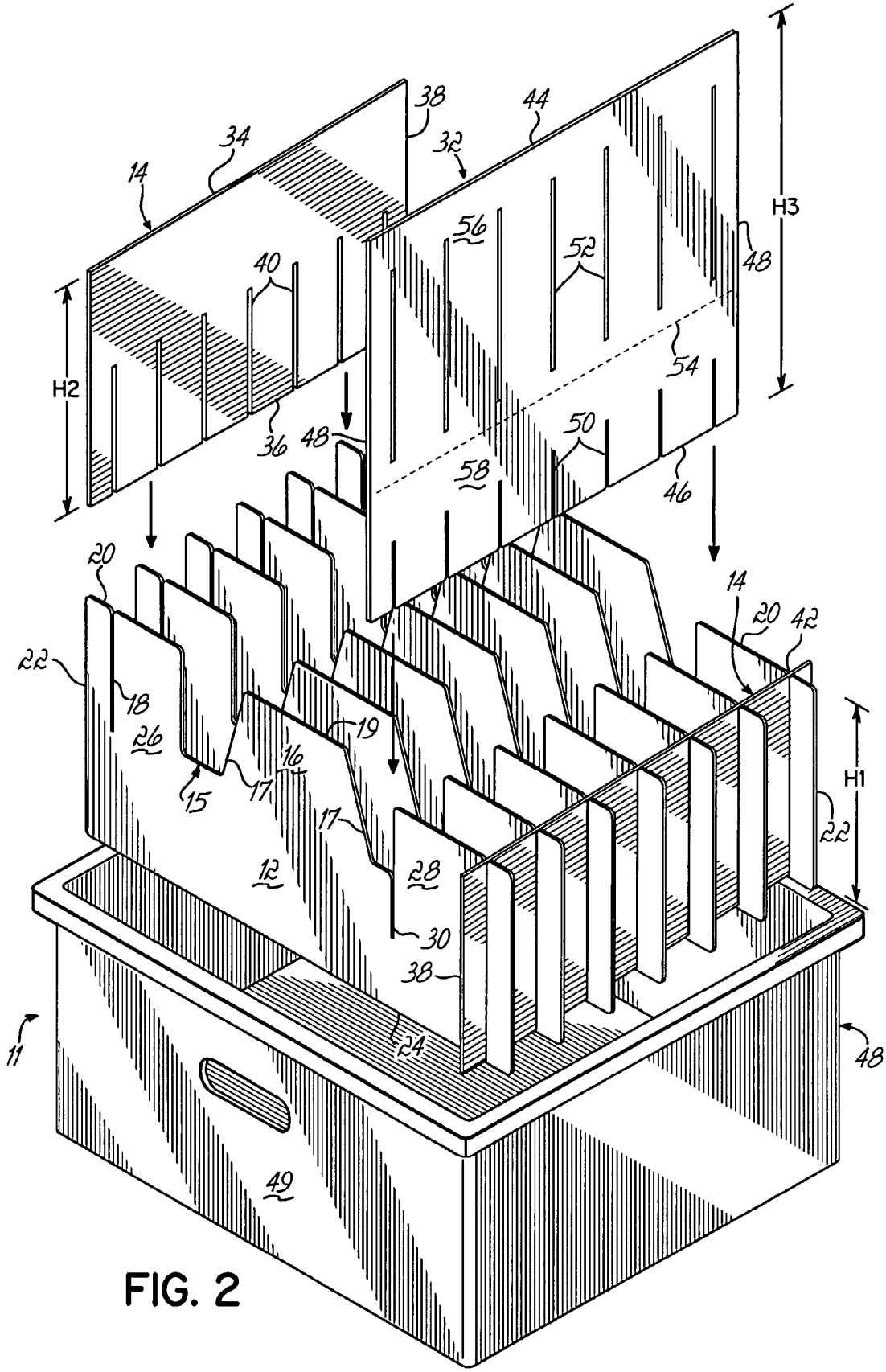
FIG. 2 shows the partition assembly of FIG. 1A being assembled with the section divider in its unfolded position and being inserted into the partition assembly.

As best illustrated in FIGS. 1A and 2, the partition assembly 10 has a plurality or first set of parallel dividers or partitions 12 which are engaged with a plurality or second set of parallel dividers or partitions 14. Each of the dividers 12 of the first set of parallel dividers has a tongue 16, and, as best viewed in FIG. 2, a plurality of slots 18 extending downwardly from an upper edge 20 of the divider 12. As best illustrated in FIG. 2, each divider 12 also has a pair of side edges 22 and a lower edge 24, the distance between the upper and lower edges 20, 24 defining the height H1 of the each divider 12. In addition, each divider 12 of the first set of parallel dividers shown in FIG. 1 has a first end portion 26 and a second end portion 28 on opposite sides of the tongue 16. Between each end portion 26, 28 and the tongue 16 is a valley 15 which is generally U-shaped. The tongue 16 has a pair of edges 17 which converge as they extend upwardly and terminate at a linear upper edge 19 of the tongue 16. Each divider 12 of the first set of parallel dividers also has an internal slot 30 sized and located to receive a section divider 32 which is described in more detail below. Although one configuration of divider 12 is illustrated, other configurations or shapes of dividers of the first set of dividers may be utilized in the present invention.

As best illustrated in FIGS. 1A and 2, each divider 14 of the second set of parallel dividers, other than the section divider 32, has an upper edge 34, a lower edge 36 and side edges 38. The distance between the upper and lower edges 34, 36 defines the height H2 of each of the dividers 14. A series of spaced slots 40 extend upwardly from the lower edge 36 of each of the dividers 14. See FIG. 2. These spaced slots 40 engage slots 18 of dividers 12 at intersections 42 when the partition assembly 10 is assembled. See FIG. 1A. In alternative embodiments, the parallel dividers 12 and 14 may be fixedly attached or connected to each other. For example, they could be extruded together, glued together, welded together, or otherwise formed or attached together.

As illustrated in FIG. 1, the section divider 32 may be integrally stored as part of the collapsed partition assembly 10, or may be stored separately and inserted into the remainder of the partition assembly as shown in FIG. 2. As best viewed in FIG. 2, section divider 32 has an upper edge 44, a lower edge 46 and a pair of side edges 48. The distance between the upper and lower edges 44, 46 defines the height H3 of the section divider 32. In the illustrated preferred embodiment, the height H3 of the section divider 32 is greater than the height H1 of the dividers 12 and the height H2 of the dividers 14. A series of spaced parallel slots 50 extending inwardly and more particularly, upwardly from the lower edge 46 of the section divider 32 are adapted to engage the respective internal slots 30 of the dividers 12. See FIG. 2 The section divider 32 also has a series of passages 52 which engage the respective tongues 16 of the dividers 12.

As shown in FIG. 2, section divider 32 also has a horizontal fold line 54. The fold line 54 separates a first upper portion 56 of the section divider 32 from a second lower portion 58 of the section divider 32. This fold line 54 may be formed by partially perforating the section divider 32 to create a foldable or bendable hinge. Typically, this would be the case when the section divider 32 is made of cardboard, chipboard or like material. As shown in FIG. 2, the passages 52 are located in the first, upper portion 56 of the section divider 32 while the slots 50 are located in the second, lower portion 58 of the section divider 32.

Figure 1B:
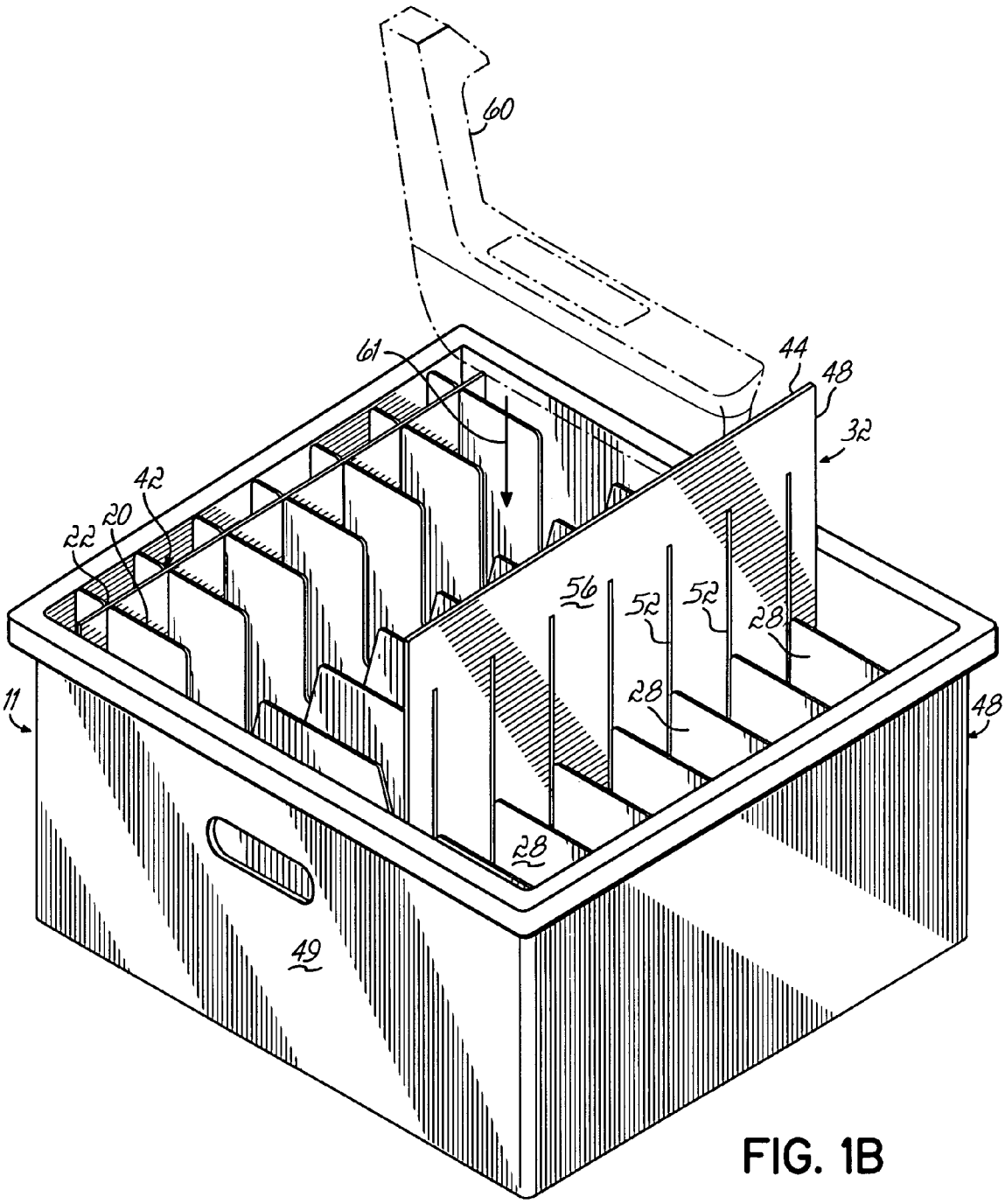
FIG. 1B shows the partition assembly and container of FIG. 1A, with the partition assembly fully inserted in the container, and showing in phantom, the insertion of an irregularly-shaped part in one of the cells of the container.
Figure 1C:
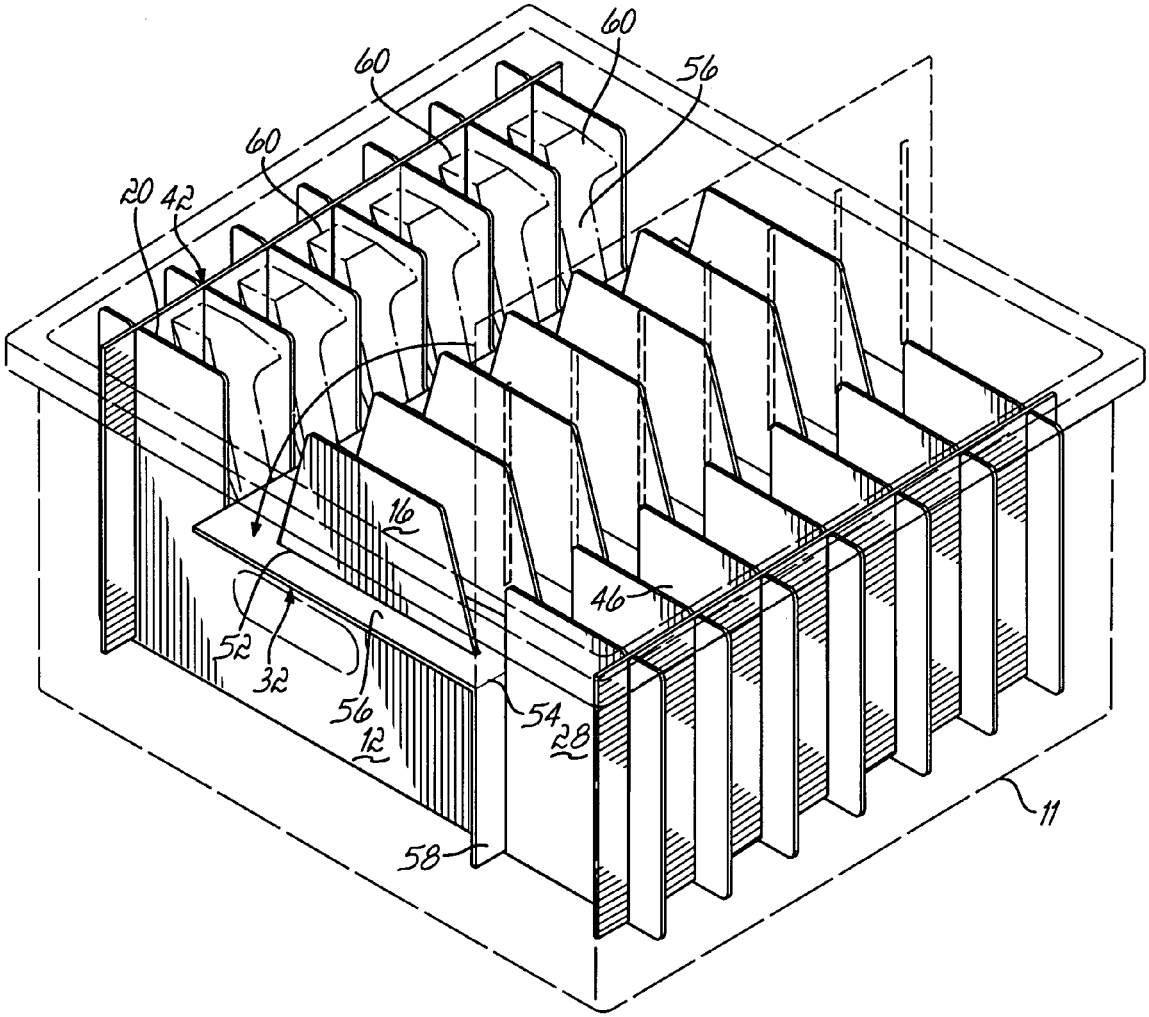
FIG. 1C is a perspective view of the partition assembly of FIG. 1A, located in a container, shown in phantom, and shown after the lower tier or level of parts, also shown in phantom, are loaded in the container and the section divider has been folded into its orthogonal position.

In an embodiment that allows for the section divider 32 to be bent along fold line 54, the section divider 32 remains in a planar configuration until parts 60 are lowered in the direction of arrow 61 into cells in the lower tier or level 62 of the container 11. See FIG. 1B. Referring to FIG. 1C, after all the cells in the lower tier or level 62 of the container (below the first portion 56 of section divider 32) are filled with product or parts 60, the section divider 32 is then folded along fold line 54 so that the tongues 16 of the dividers 12 pass through the passages 52 in the first upper portion 56 of the section divider 32. The first upper portion 56 of the section divider 32 then is in a horizontal orientation and functions to separate the interior of the container 11 into a lower tier or level 62 and an upper tier or level 64. See FIG. 1D.

After the first upper portion 56 of the section divider 32 is folded along fold line 54 and oriented substantially horizontally as shown in FIG. 1C, additional parts 66 are lowered in the direction of arrow 68, i.e. loaded into the cells of the second or upper tier or level 64. See FIG. 1D.

However, in alternative embodiments, such as an embodiment where the section divider 32 is made of plastic, the fold line 38 is typically created by bending the partition 34*a* over a hotwire. In such embodiments, the section divider 32 may be pre-bent along fold line 54 so as to retain an L-shaped configuration. Such a rigid orthogonal L-shaped divider could be comprised of any suitable packaging material, including plastic, cardboard, chipboard, metal or the like. Such a rigid L-shaped divider may be created any number of ways; the present invention is not intended to limit the method of creating such a divider.

Figure 1D:
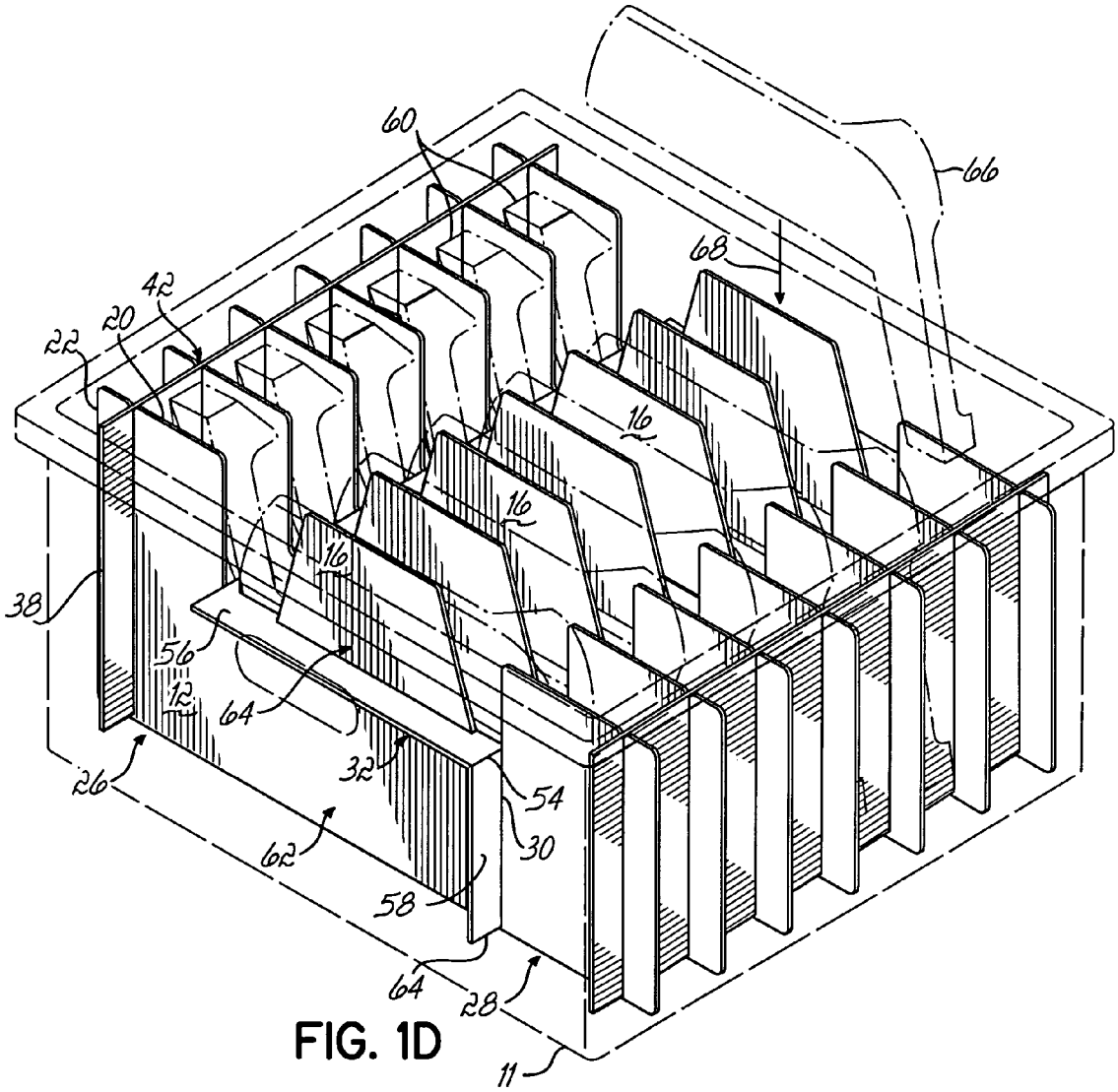
FIG. 1D shows the partition assembly of FIG. 1A with the upper tier or level of parts, shown in phantom, in the container.

As shown in FIG. 1A, the partition assembly 10, in its assembled form is positioned to be inserted into a container or box 11. The container 11 is typically made out of cardboard, chipboard, plastic, or like packaging materials. As shown in FIG. 1B, once the partition assembly 10 is inserted into the container 11, the container 11 is ready to receive product or parts in its cells. As shown in FIG. 1C, once all of the lower cells of the container 11 are filled with a product or part 60, the upper portion 56 of the section divider 32 may be folded along the fold line 54 so that the passages 52 of the section divider 32 engage the tongues 16 of dividers 12. When folded, the section divider 32 helps to secure the lower tier products 60 in their respective cells and provides a platform or shelf for receiving products 66 into the cells of the second or upper level or tier 64 of the container. As shown in FIG. 1D, a second or upper tier of products or parts 66 can then be placed in a second set of cells and can rest upon the shelf created by the folded section divider 32.

The present invention also comprises a method for forming a partition assembly 10 for dividing the space inside a container 11. The method comprises steps of engaging the slots 18 of dividers 12 with the slots 40 of dividers 14 and engaging the tongue 16 of each divider 12 with the passages 52 of the section divider 32. An additional step of folding section divider 32 may be used in certain embodiments.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A partition assembly for dividing space inside a container comprising:

a first set of parallel dividers, each of said dividers having at least one tongue and at least one slot on each side of said at least one tongue and spaced inwardly from side edges of the divider;

a second set of parallel dividers;

the first set of parallel dividers being engaged with the second set of parallel dividers so that each divider of the first set of parallel dividers intersects each divider of the second set of parallel dividers at an intersection; and wherein one divider of the second set of parallel dividers has a fold line and a series of spaced passages in an upper portion of the one divider above the fold line when the one divider is in a planar configuration, the tongues of the dividers of the first set of dividers passing through the spaced passages and the entire upper portion of the one divider being horizontal when the one divider of the second set of parallel dividers is folded along the fold line.

2. The partition assembly of claim 1 wherein the first set of parallel dividers has a series of spaced slots and the second set of parallel dividers has a second series of spaced slots, the slots in each divider extending inwardly from an edge of the divider, the slots of the first set of parallel dividers being engaged with the slots of the second set of parallel dividers.

3. The partition assembly of claim 1 wherein the partition assembly is collapsible.

4. The partition assembly of claim 1 wherein the dividers of the first set of parallel dividers and the dividers of the second set of parallel dividers are fixedly attached to one another.

5. The partition assembly of claim 1 wherein the one divider is foldable along the fold line such that after being folded the one divider has a first portion and a second portion orthogonal to the first portion.

* * * * *